US008157362B1

(12) United States Patent
Turgeman

(10) Patent No.: US 8,157,362 B1
(45) Date of Patent: Apr. 17, 2012

(54) INK JET PRINTER CARTRIDGE REFILLING METHOD AND APPARATUS

(76) Inventor: Shahar Turgeman, Boca Raton, FL (US)

( * ) Notice: Subject to any disclaimer, the term of this patent is extended or adjusted under 35 U.S.C. 154(b) by 381 days.

(21) Appl. No.: 12/575,438

(22) Filed: Oct. 7, 2009

Related U.S. Application Data

(63) Continuation of application No. 11/342,442, filed on Jan. 30, 2006, now abandoned.

(51) Int. Cl.
*B41J 2/175* (2006.01)

(52) U.S. Cl. ..... 347/85

(58) Field of Classification Search ..... 347/7, 22, 347/84, 85, 86, 87; 141/2, 18
See application file for complete search history.

(56) References Cited

U.S. PATENT DOCUMENTS 4,907,013 A 3/1990 Hubbard et al.
5,164,747 A 11/1992 Osada et al.
5,663,754 A 9/1997 Lorenze, Jr. et al.
5,835,108 A 11/1998 Beauchamp et al.
5,927,547 A * 7/1999 Papen et al. ..... 222/57
6,056,386 A 5/2000 Nohata et al.
6,058,984 A 5/2000 Sato
6,106,094 A 8/2000 Otani et al.
6,158,837 A 12/2000 Hilton et al.
6,215,557 B1 4/2001 Owens
6,261,353 B1 7/2001 Doi et al.
6,273,151 B1 8/2001 Kong
6,289,654 B1 9/2001 Yamaguchi et al.
6,315,383 B1 11/2001 Sarmast et al.
6,331,038 B1 12/2001 Boleda et al.
6,352,331 B1 3/2002 Armijo et al.
6,361,138 B1 3/2002 Seino et al.
6,539,985 B2 4/2003 Shinada et al.
6,568,786 B2 5/2003 Sarmast et al.
6,585,007 B2 7/2003 Kubokawa
6,612,683 B2 * 9/2003 Takahashi et al. ..... 347/30
6,616,260 B2 9/2003 Skene et al.
6,623,096 B1 9/2003 Castano et al.
6,637,853 B1 10/2003 Ahne et al.
6,644,772 B2 11/2003 Choi
6,679,577 B2 1/2004 Du et al.
6,705,694 B1 3/2004 Barbour et al.
6,729,360 B2 5/2004 Sesek et al.
6,764,155 B2 7/2004 D'Souza et al.
6,783,215 B2 * 8/2004 Yoshida et al. ..... 347/85
7,089,973 B2 8/2006 Nicodem et al.
7,172,272 B2 2/2007 Tsuchiya et al.
7,344,215 B2 3/2008 Cutler et al.
7,540,597 B2 6/2009 Guhse et al.
2001/0019343 A1 9/2001 Walker et al.
2002/0149641 A1 10/2002 Du et al.
2002/0175965 A1 11/2002 Skene et al.
(Continued)

*Primary Examiner* — Anh T. N. Vo
(74) *Attorney, Agent, or Firm* — Allen D. Hertz, P.A.; Allen D. Hertz

(57) ABSTRACT

The present invention comprises a method and system for refilling printer ink cartridges. The method and system refill the cartridge while under a vacuum, and provide a positive displacement, peristaltic pump that is automatically operated a precise amount of time to ensure that the proper amount of ink is added to the cartridge. In addition, the filling pump's operation is periodically paused during the refilling process to ensure that air within the foam sponge that retains the ink typically in most printer cartridges can migrate out of the sponge.

21 Claims, 6 Drawing Sheets

U.S. PATENT DOCUMENTS

| | | | |
|---|---|---|---|
| 2003/0081062 | A1 | 5/2003 | Kim et al. |
| 2003/0146951 | A1 | 8/2003 | Skene et al. |
| 2004/0046811 | A1 | 3/2004 | D'Souza et al. |
| 2004/0263588 | A1 | 12/2004 | Ansier et al. |
| 2004/0263589 | A1 | 12/2004 | Ansier et al. |
| 2005/0018006 | A1 | 1/2005 | Im et al. |
| 2005/0034777 | A1 | 2/2005 | Nicodem et al. |
| 2005/0088495 | A1 | 4/2005 | Chan |
| 2005/0099447 | A1 | 5/2005 | Hsu et al. |
| 2006/0109320 | A1 | 5/2006 | Cutler et al. |
| 2007/0051421 | A1 | 3/2007 | Sarnoff et al. |
| 2007/0052740 | A1 | 3/2007 | Guhse et al. |
| 2007/0052748 | A1 | 3/2007 | Sarnoff et al. |
| 2007/0052770 | A1 | 3/2007 | Guhse et al. |
| 2007/0052776 | A1 | 3/2007 | Guhse et al. |
| 2007/0052777 | A1 | 3/2007 | Guhse et al. |

* cited by examiner

300

| 325 Printer Type | 330 Cartridge Model No. | 335 Required Ink Amount | 340 Run Time | 345 Pause Time |
|---|---|---|---|---|
| 1200 | 51640/C/M/Y | 42 | 1 | 1 |
| 5550 | C6657 | 17 | 1 | 2 |
| 2000C | C4841/C/M/Y | 28 | 2 | 3 |
| 1120 | C1823D | 30 | 1.5 | 1 |

305 310 315 320

FIG. 3

INK JET PRINTER CARTRIDGE REFILLING METHOD AND APPARATUS

CROSS REFERENCE TO RELATED APPLICATIONS

This application is a Continuation Application of co-pending U.S. patent application Ser. No. 11/342,442, filed Jan. 30, 2006, the contents of which, including the computer program listing, are incorporated herein by reference into the present application.

REFERENCE TO A COMPUTER PROGRAM LISTING APPENDIX

Annexed to this application, via reference from the parent application, is a computer program listing of a Visual Basic program on CD-ROM. This CD-ROM comprises 11 files named (and having size of): Code.txt (1,061,725 bytes), EXIT_Button. doc (26,112 bytes), Find.doc (59,904 bytes), Flash_screen.doc (49,664 bytes), MAIN_SCREEN. doc (194,560 bytes), MDIrecord.doc (31,232 bytes), PrintFormTEST.doc (37,888 bytes), REG.doc (28,160 bytes), Resolution.doc (33,280 bytes), SpreadOCX.doc (69,120 bytes) and TransParentFunction.doc (23,040 bytes), all created on Jan. 12, 2006, each of which are incorporated by reference herein.

FIELD OF THE INVENTION

The present invention relates to the field of refilling spent ink cartridges. In particular, the present invention relates to an automated system and method for refilling ink cartridges for ink jet printers.

BACKGROUND OF THE INVENTION

Ink jet printers are a popular form of printer used with computers and similar applications involving document printing or graphics preparation. Typical ink jet printers, such as those manufactured by Original Equipment Manufacturers (OEMs) such as Hewlett Packard, have replaceable ink jet cartridges with built-in print heads. While such OEM ink jet cartridges are a convenient manner of supplying ink to such printers, the cartridges are necessarily expensive due to their complexity and the provision of print heads with the cartridges.

Cartridges provided by printer manufacturers are typically not designed to be refilled when the ink supply runs out. It is well known, however, that such cartridges and their associated print heads have useful lives significantly longer than that provided by the initial supply of ink. Therefore, an aftermarket industry has evolved, that is directed to providing systems for refilling cartridges with ink. The need to provide ink refilling is especially acute in the case of color ink cartridges, because typically one color will run out of ink before the other colors are depleted.

Refilling ink cartridges with ink is not an easy task. First, some means must be provided to supply the ink to the interior of the cartridges~Because the ink reservoirs are typically filled with foam sponge, the ink refilling process is slow due to slow absorption of ink by the foam. Users typically do not have the patience to refill slowly (typically by squeezing a refill reservoir or by gravity feed), and this causes ink to flow into the foam sponge at a rate that is usually too fast to be absorbed. Ink accumulates in the bottom of the cartridge and overflows from the top and from the print head.

To help speed the process, some refilling mechanisms of the prior art pressurize the ink while refilling the cartridge. See, e.g., U.S. Pat. No. 6,945,640 to Cheok, incorporated by reference herein. Such pressurization merely exacerbates an air injection problem, by inducting air along with the ink filling the cartridge, and by preventing the removal of air from the foam sponge. The air injected into the foam sponge reservoir during refilling causes vapor lock in the ink reservoir. Ink then cannot reach the print head, and the printer fails. In order to overcome this problem, Cheok teaches that the air must subsequently be removed through vacuum evacuation of the cartridge. However, Cheok does not teach how much ink to add to the cartridge.

Prior art refilling mechanisms may not inject the proper quantity of ink into the reservoir. Such overfilling may bind the internal cartridge ink pump, create a mess from weeping ink, and may prevent the cartridge from functioning properly.

In order to avoid vapor lock, U.S. Pat. No. 4,967,207 to Ruder teaches completely evacuating the cartridge, and then supplying ink to refill the cartridge. In essence, Ruder improperly teaches that the vacuum within the cartridge will suck the proper amount of ink back into it. However, it is impossible to achieve a perfect vacuum. If the cartridge could structurally withstand a near perfect vacuum without being damaged, in Ruder's process, the cartridge would be completely filled with ink, and thus would be overfilled. A less than perfect vacuum will not fill the cartridge completely. A properly filled cartridge has a precise quantity of ink, and a certain amount of airspace. Therefore, Ruder does not solve the ink quantity problem.

U.S. Pat. No. 4,968,998 to Allen discloses refilling the cartridge while evacuating, such that the evacuation rate exceeds the filling rate. This Patent states that the cartridge can never be overfilled; however, if the air were completely removed from the cartridge, which would eventually happen by Allen's method, the airspace in the cartridge would no longer exist.

U.S. Pat. No. 5,903,292 to Scheffelin et al. teaches refilling a spring-loaded collapsible ink bag, which maintains a negative pressure to draw ink into the bag until it is substantially full. However, many commercially available print cartridges are not constructed with such spring-loaded bags.

Another prior art solution to these refilling problems is a "Clip-In" type refill system. The original ink cartridge is modified by removing all of the original ink reservoirs, such that only the print heads and the case are left. Removable ink reservoirs are supplied, so the user only has to change the ink reservoir assembly causing no mess. The disadvantage of this system is that it the user must be supplied with a pre-modified cartridge specially-adapted for use only with the removable ink reservoirs, and in practice, this system is nearly as costly as OEM printer cartridges.

Thus, there presently exists a need for a simple method and apparatus for refilling printer ink cartridges that eliminates the problems of slow refilling, overfilling and potential vapor lock.

BRIEF SUMMARY OF THE INVENTION

The present invention comprises a method and system for refilling printer ink cartridges. The method and system refill the cartridge while under a vacuum, and provide a positive displacement, peristaltic pump that is automatically operated a precise amount of time to ensure that the proper amount of ink is added to the cartridge. In addition, the filling pump's operation is periodically paused during the refilling process to ensure that air within the foam sponge that retains the ink typically in most printer cartridges can migrate out of the sponge.

In one aspect, the present invention is directed to a method of refilling a printer ink cartridge, the method comprising:

placing the cartridge in a vacuum chamber;

reducing pressure in the vacuum chamber to between 0.4 to 0.9 millibars below atmospheric;

adding an amount of ink during a first time period while the cartridge is under a vacuum;

repeating the adding step until a required amount of ink has been added to the cartridge.

In another aspect of the present invention, the pressure in the vacuum chamber is reduced to about 0.7 millibars below atmospheric.

In another aspect of the present invention, the required amount of ink is determined from cartridge identifying information.

In another aspect of the present invention, the required amount of ink is based on a difference in weight of a new cartridge and an empty cartridge.

In another aspect of the present invention, a number of times the adding step is repeated is based on the amount added during the first time period and the required amount of ink.

In another aspect of the present invention, the method further comprises pausing for a second time period between adding steps.

In another aspect of the present invention, the method further comprises removing ink from the cartridge by centrifuge if the cartridge weighs more than about two grams above an empty weight.

In another aspect of the present invention, the method further comprises ultrasonically cleaning the cartridge.

In another aspect of the present invention, the method further comprises steam cleaning a print head on the cartridge.

In another aspect, the present invention is directed to a computerized system for refilling an ink cartridge, comprising:

a general purpose computer that executes program code;

a database stored on the computer, wherein the database comprises ink cartridge information;

a user interface for receiving ink cartridge information;

a vacuum chamber;

a vacuum pump that can draw a suction on the vacuum chamber to reduce pressure in the vacuum chamber to between 0.4 to 0.9 millibars below atmospheric;

a positive displacement ink filling pump under control of the computer; and one or more software modules comprising program code that, when executed by the computer, cause the computer to:

receive cartridge identifying information from the user interface;

run the ink filling pump to add ink to the cartridge during a first time period; and repeat the running step until a required amount of ink has been added to the cartridge.

In another aspect of the present invention, the vacuum pump reduces pressure in the vacuum chamber to about 0.7 millibars below atmospheric.

In another aspect of the present invention, the vacuum pump and ink filling pump are peristaltic pumps.

In another aspect of the present invention, the program code, when executed by the computer, cause the computer to pause the ink filling pump for a second time period between running steps.

In another aspect of the present invention, the first time period has a shorter duration than the second time period.

In another aspect of the present invention, the database comprises one or more of the first time period, the second time period, the cartridge identifying information and the required amount.

In another aspect of the present invention, the required amount of ink is determined from cartridge identifying information.

In another aspect of the present invention, the required amount of ink is based on a difference in weight of a new cartridge and an empty cartridge.

In another aspect of the present invention, a number of times the running step is repeated is based on the amount added during the first time period and the required amount of ink.

In another aspect, the present invention is directed to program code stored on media that automates the process of refilling printer ink cartridges, wherein the code, when executed by a processor, causes the processor to:

receive cartridge identifying information from user input;

add ink to the cartridge for a first time period and pause for a second time period; and repeat the add and pause steps until a required amount of ink has been added to the cartridge;

wherein the first and second time periods depend upon cartridge identifying information.

In another aspect of the present invention, program code further causes the processor to determine a number of times the add and pause steps are repeated, based on the amount added during the first time period and the required amount of ink.

BRIEF DESCRIPTION OF THE DRAWINGS

FIG. 3 is a chart that illustrates an exemplary database schema;

DETAILED DESCRIPTION OF THE INVENTION

Figure 1:
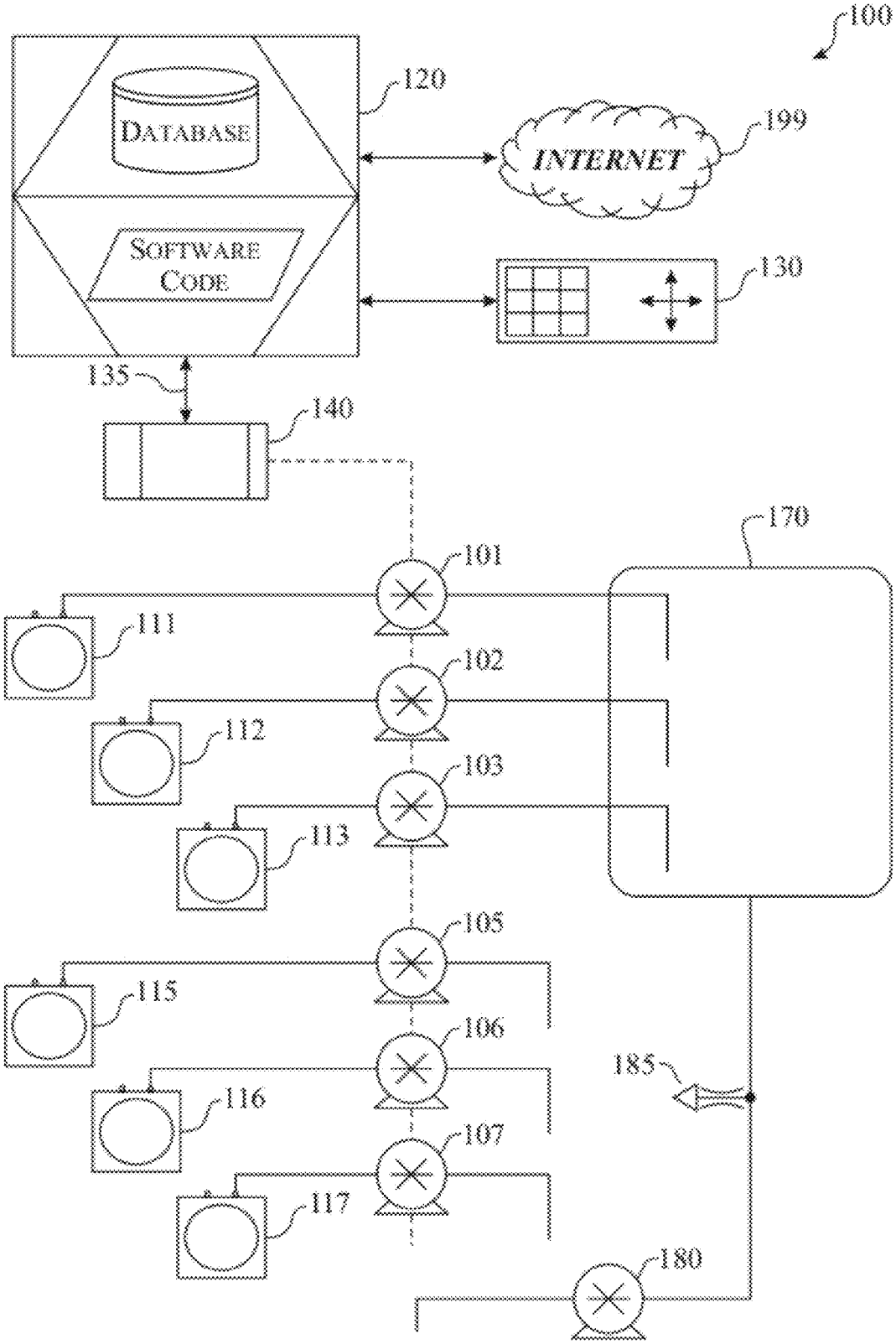
FIG. 1 is a block diagram illustrating a system for refilling a printer cartridge.

The present invention comprises a system for refilling a printer ink cartridge. In a preferred embodiment, the method and system refill the cartridge while the cartridge is under a vacuum to prevent vapor lock. The system preferably comprises a positive displacement, peristaltic ink filling pump that operates under computer control to ensure that the proper amount of ink is added to the cartridge without overfilling the cartridge. The method preferably incorporates filling the cartridge while under vacuum, with pauses between filling events to ensure that air can migrate out of the cartridge. As described below, the filling and pause cycle times are dependent upon the type of cartridge being filled.

The present invention may be described herein in terms of functional block components, code listings, optional selections and various processing steps. It should be appreciated that such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices.

Similarly, the software (program code) elements of the present invention may be implemented with any programming or scripting language such as C, C++, C#, Java, COBOL, assembler, PERL, or the like, with the various algorithms being implemented with any combination of data structures, objects, processes, routines or other programming elements. The system preferably incorporates software modules preferably programmed in Visual C and Visual Basic. The object code created can be executed by any computer having a Microsoft Windows 95 or higher operating system.

Further, it should be noted that the present invention may employ any number of conventional techniques for data transmission, signaling, data processing, network control, and the like.

It should be appreciated that the particular implementations shown and described herein are illustrative of the invention and its best mode and are not intended to otherwise limit the scope of the present invention in any way. Indeed, for the sake of brevity, conventional data networking, application development, and other functional aspects of the systems (and components of the individual operating components of the systems) may not be described in detail herein. Furthermore, the connecting lines shown in the various figures contained herein are intended to represent exemplary functional relationships and/or physical or virtual couplings between the various elements. It should be noted that many alternative or additional functional relationships or physical or virtual connections might be present in a practical electronic data communications system.

As will be appreciated by one of ordinary skill in the art, the present invention may be embodied as a method, a data processing system, a device for data processing, and/or a computer program product. Accordingly, the present invention may take the form of an entirely software embodiment, an entirely hardware embodiment, or an embodiment combining aspects of both software and hardware. Furthermore, the present invention may take the form of a computer program product on a computer-readable storage medium having computer-readable program code means embodied in the storage medium. Any suitable computer-readable storage medium may be utilised, including hard disks, CDROM, optical storage devices, magnetic storage devices, and/or the like.

The present invention is described below with reference to-block diagrams and flowchart illustrations of methods, apparatus (e.g., systems), and computer program products according to various aspects of the invention. It will be understood that each functional block of the block diagrams and the flowchart illustrations, and combinations of functional blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions that execute on the computer or other programmable data processing apparatus create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, functional blocks of the block diagrams and flowchart illustrations support combinations of means for performing the specified functions, combinations of steps for performing the specified functions, and program instruction means for performing the specified functions. It will also be understood that each functional block of the block diagrams and flowchart illustrations, and combinations of functional blocks in the block diagrams and flowchart illustrations, can be implemented by either special purpose hardware-based computer systems that perform the specified functions or steps, or suitable combinations of special purpose hardware and computer instructions.

One skilled in the art will also appreciate that, for security reasons, any databases, systems, or components of the present invention may consist of any combination of databases or components at a single location or at multiple locations, wherein each database or system includes any of various suitable security features, such as firewalls, access codes, encryption, de-encryption, compression, decompression, and/or the like.

The scope of the invention should be determined by the appended claims and their legal equivalents, rather than by the examples given herein. For example, the steps recited in any method claims may be executed in any order and are not limited to the order presented in the claims. Moreover, no element is essential to the practice of the invention unless specifically described herein as "critical" or "essential."

System Architecture

FIG. 1 is a block diagram that illustrates a preferred embodiment for a computer ink cartridge refilling system 100. As shown in FIG. 1 system 100 comprises a computer 120 comprising a database 125 and software program code 150 and a touch screen 130. As shown, computer 120 is interfaced with the Internet 199. Communications between computer 120 and troubleshooting facilities may be physically facilitated through cable or wireless links on which electronic signals can propagate, and may be embodied, for example, as (i) a dedicated wide area network (WAN), (ii) a telephone network, including the combination of local and long distance wire or wireless facilities and switches known as the public switched telephone network ("PSTN"), or (iii) the Internet 199.

Computer 120 is preferably interfaced through an RS-232 serial port to relay board 140 via communications cable 135. Under the control of computer 120, relay board 140 supplies power to various motors to control the operation of attached pumps. As illustrated in FIG. 1, these pumps are color ink pumps 101-103, comprising yellow 101, cyan 102, and magenta 103, waste pump 105, cleaning pump 106, and black ink pump 107. Each ink pump draws ink from an associated reservoir, yellow Ill, cyan 112, magenta 113 and black 117 and supplies the ink via a needle inserted into the cartridge. Preferably, each pump is a positive displacement, peristaltic pump that can be run in the reverse direction, so that residual ink can be removed from the line and returned to the reservoir.

Waste pump 105 draws liquid from the cartridge into a waste reservoir 115. Cleaning pump 106 supplies a cleaning solvent drawn from associated reservoir 116 to the cartridge via a needle inserted into the cartridge.

Ink lines from color ink pumps 101-103 run through the wall of a vacuum chamber 170. The associated needle may be inserted into the cartridge to be refilled. Vacuum chamber 170 has a door that can be opened to place the cartridge within the chamber. Preferably, the door seats on a sealing surface of the chamber.

Air from vacuum chamber 170 is removed by vacuum pump 180. As air is removed from the chamber, the door and sealing surface seals the vacuum chamber so that an appropriate vacuum can be drawn. Vacuumstat 185 controls the amount of vacuum that the pump 180 draws on chamber 170.

Figure 2:
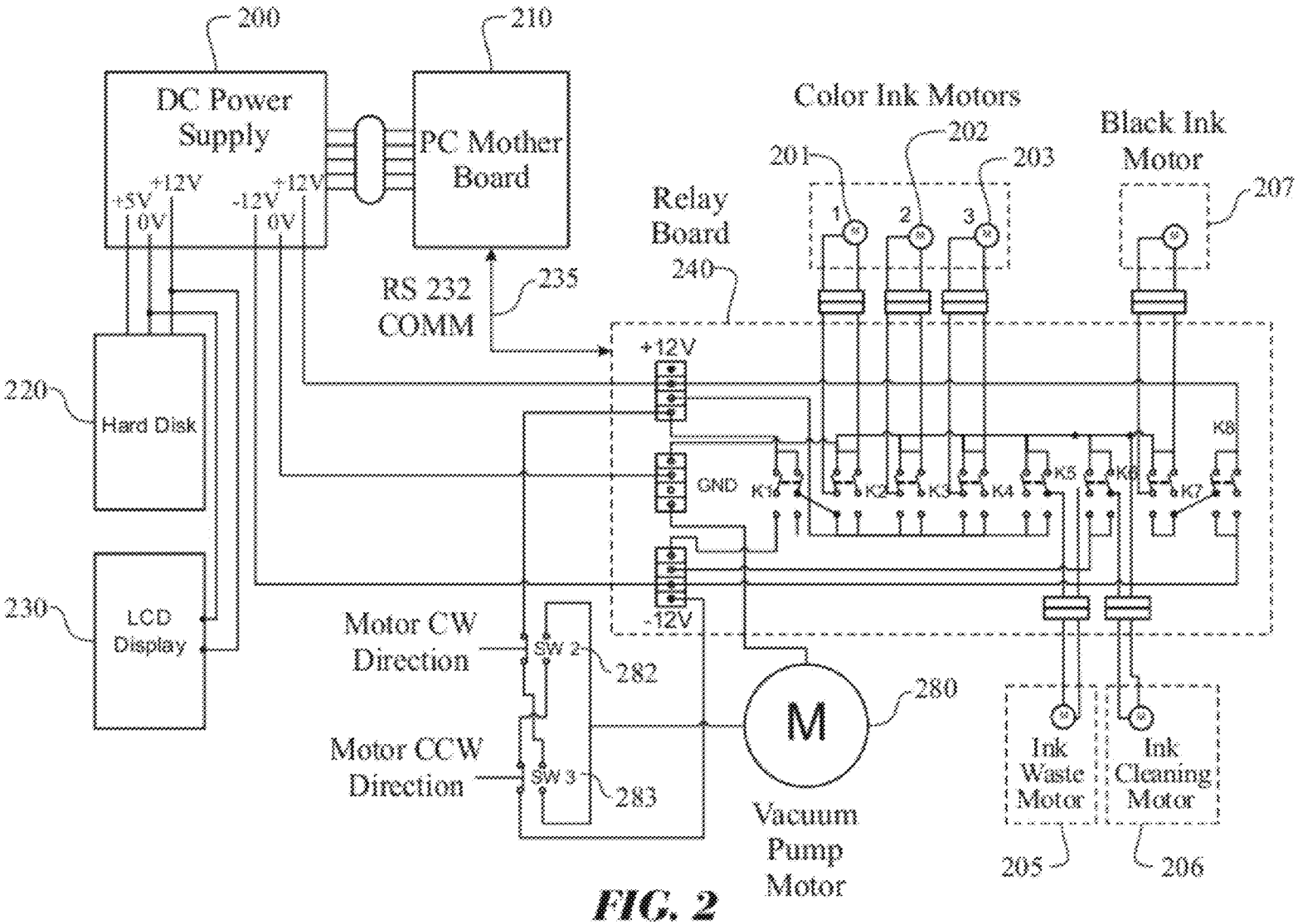
FIG. 2 is a schematic wiring diagram for the printer cartridge hue refilling system.

FIG. 2 a schematic wiring diagram for the printer cartridge ink refilling system.

As shown in FIG. 2, a DC power supply 200 provides power to PC motherboard 210, a hard disk 220, and an LCD display 230. DC power supply 200 also provides positive and negative 12 VDC to relay board 240. Relay board 240 is connected to PC motherboard 210 via RS-232 communications link 235. Relay board 240 provides 12 VDC of opposite polarities to motors 201-203, 205-207 via relays K1-K8 to run motor in either direction. Switches 282, 283 provide power to vacuum pump motor 280 to run this motor in either direction.

FIG. 3 is a chart that illustrates an exemplary database schema 300. Database 300 preferably stores information on different printers and the cartridges that are being refilled. Database 300 maintains a plurality of records, such as records 305-320, each associated with a type of printer and the print cartridge used in that printer. For each cartridge identified by a cartridge model number in field 330, database 300 includes a required amount of ink to refill the cartridge in field 335. Preferably, this amount is determined by weighing an empty cartridge and a brand new cartridge. The difference in weight times the density of the ink equals the volumetric amount of ink that must be added to the cartridge in order to refill it.

In addition, database 300 preferably includes fields for the length of time that the ink pump should be run and the length of time the ink pump should pause, during each filling cycle, in fields 340 and 345, respectively. Such fields may or may not have been part of the database schema, but may also be coded into software program code 150.

System Operation

The following discussion describes the methods performed by the inventive system. To provide context, the operation of an exemplary, preferred embodiment of software program code 150 is described in conjunction with FIGS. 4 and 5.

Figure 4:
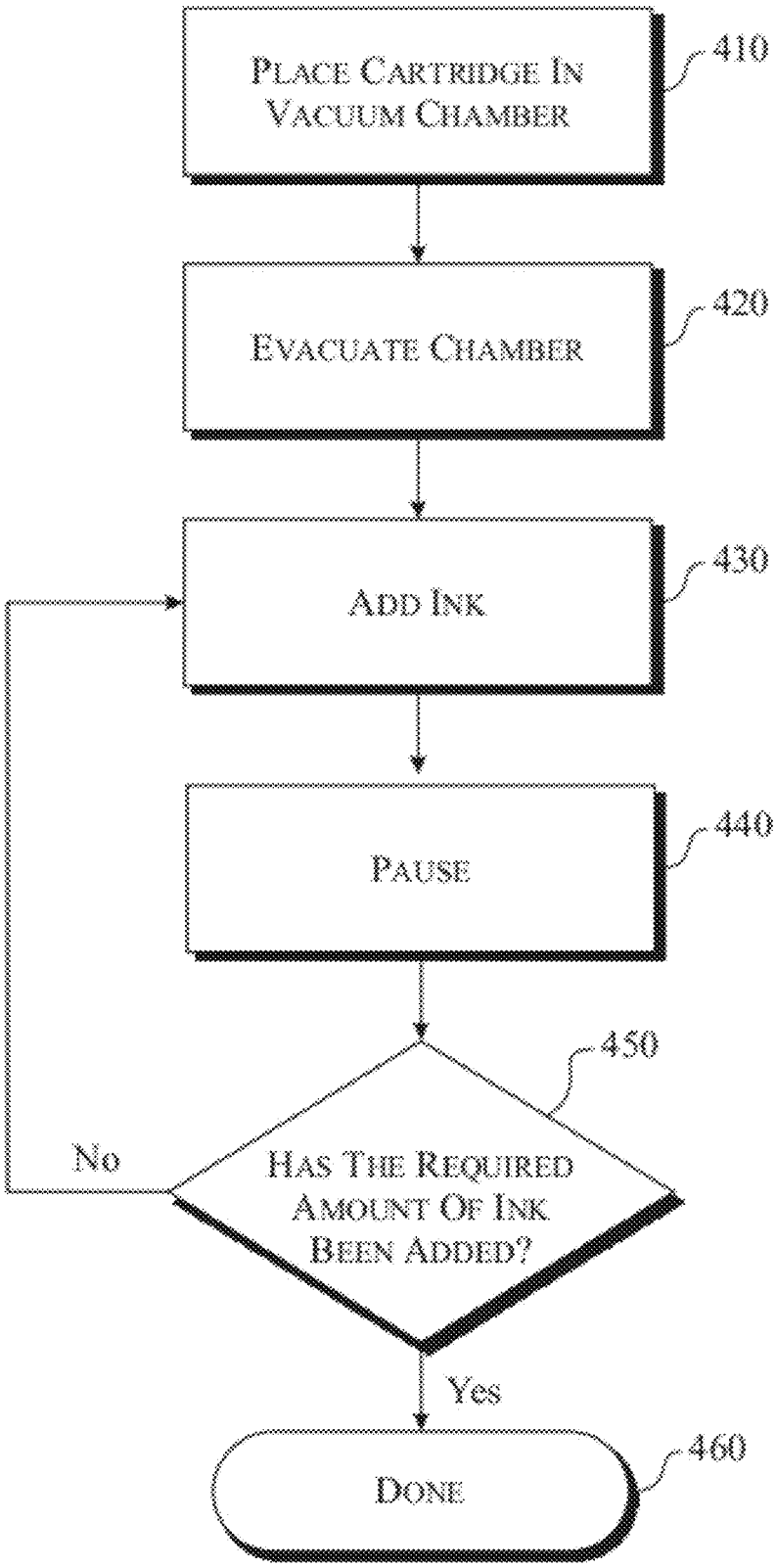
FIG. 4 is a flow chart illustrating a series of acts for refilling a printer cartridge.
Figure 5:
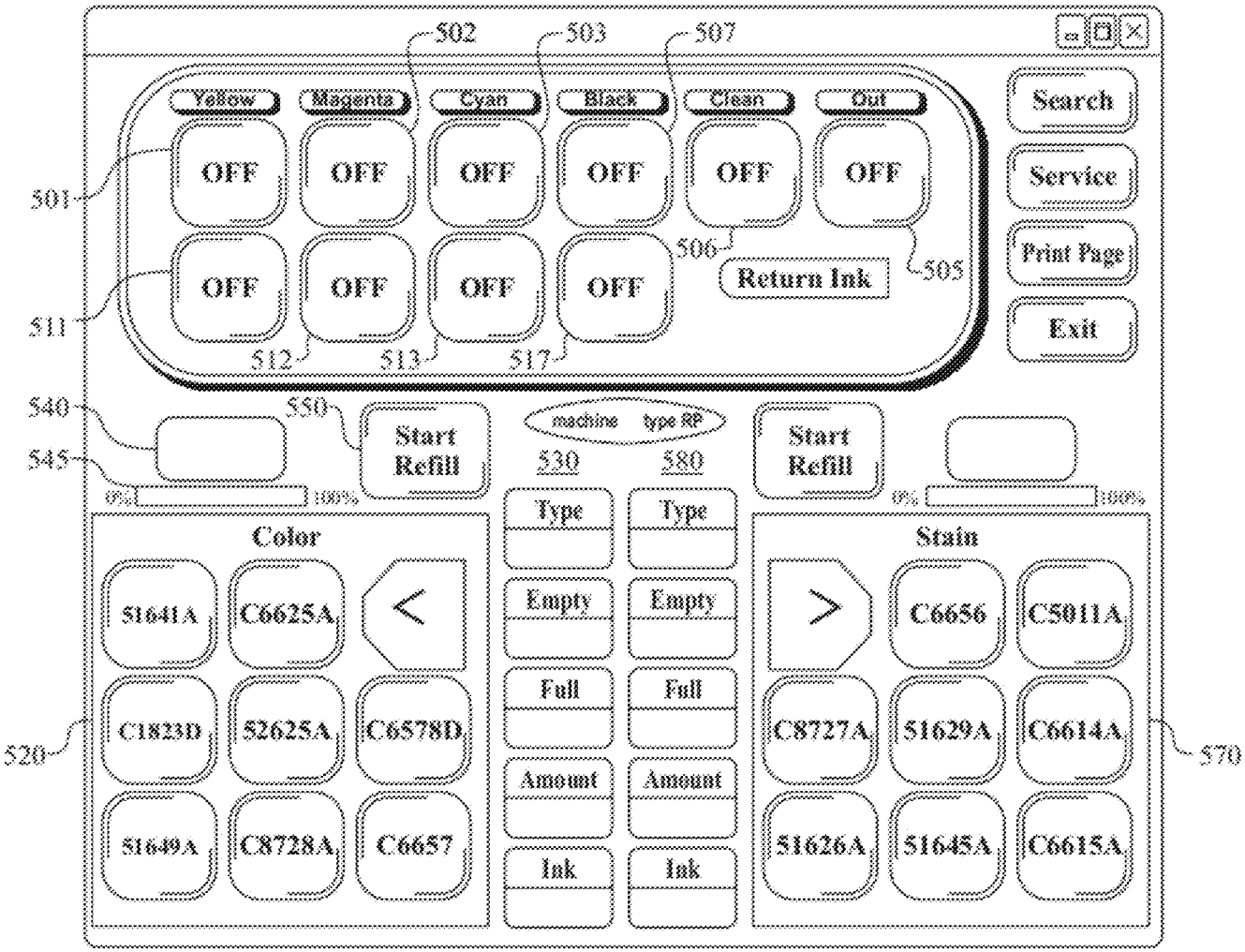
FIG. 5 is a diagram illustrating a control screen for the refilling system.
Figure 6:
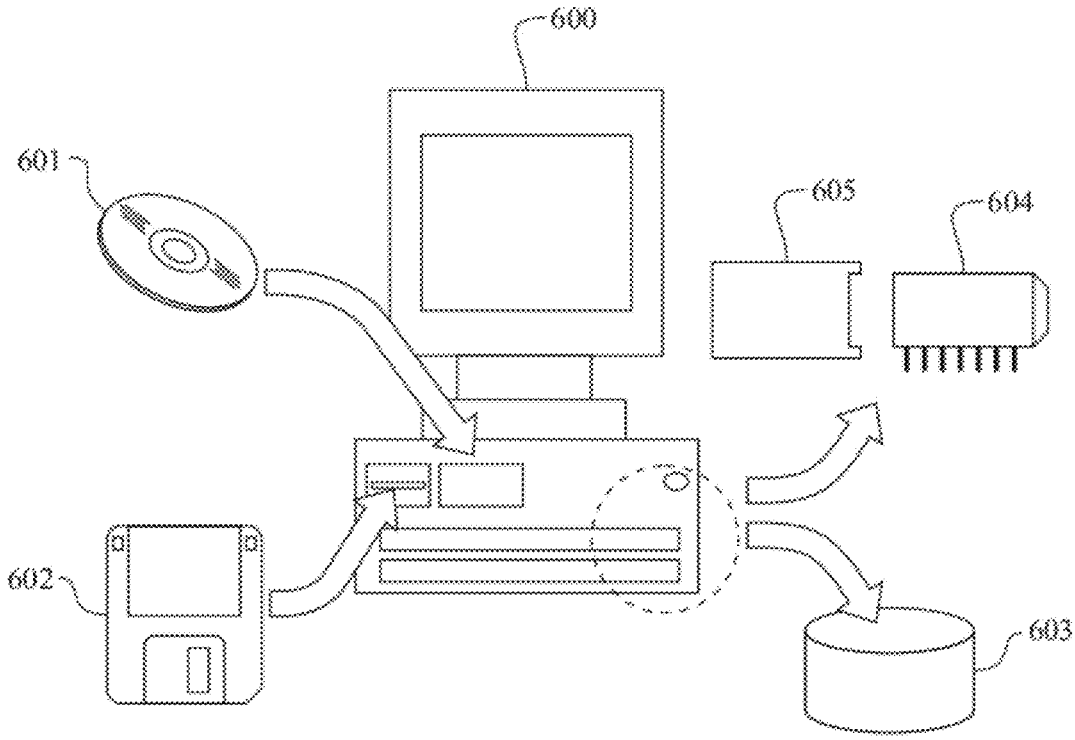
FIG. 6 illustrates examples of recording media.

FIG. 4 is a flow chart illustrating a series of acts for refilling a printer cartridge using system 100. As shown in FIG. 4, in step 410, a color cartridge being filled is placed into vacuum chamber 170. The user will provide an indication to system 100 that a particular cartridge is being refilled. This identification is described below in connection with FIG. 5.

Before the cartridge is filled, the user must determine whether the cartridge is empty. The preferred way to make this determination is to weigh the cartridge. If the cartridge weighs more than two grams above an empty weight, then the cartridge most likely contains residual ink, which should be removed. Preferably, the user can pump the residual ink out of the cartridge. If the ink cannot be removed in this fashion, then the cartridge is preferably placed in a centrifuge to remove the residual ink. In addition, dried ink may not be removed, so a cleaning solved may be necessary, which can be pumped into the cartridge, and then removed. Alternatively, the user may clean the cartridge in an ultrasonic cleaner. Additionally, the print head of the cartridge may be reconditioned by steam cleaning.

In step 420, the user places the clean, empty cartridge into vacuum chamber 170 and inserts the filling needles into the cartridge. The user manually activates vacuum pump 180, which will reduce the pressure in the chamber down to the setting provided on vacuumstat 185. Preferably, vacuumstat 185 is set to control pressure in vacuum chamber 170 to between 0.4 to 0.9 millibars below atmospheric. More preferably, vacuumstat 185 is set to control and maintain pressure in vacuum chamber 170 to about 0.7 millibars below atmospheric.

In step 430, the user initiates the automatic refilling process. Preferably, software program code 150 causes computer 120 to communicate with relay board 140 to run ink filling pump 101-103 to add ink to the cartridge. The ink is added in discrete filling steps. Computer 120 preferably runs pump 101-103 for a brief period of time, defined either in software program code 150, or as specified in database 300.

In step 440, computer 120 pauses running pump 101-103 so that the ink will permeate the foam sponge within the cartridge. As the ink displaces air in the foam, vacuum pump 180 removes the air. In a preferred embodiment, the amount of time that the pumps are paused is longer than the amount of time that they are run, so that the air can be more effectively removed.

In step 450, computer 120 determines whether the required amount of ink has been added to the cartridge. Because the ink pump is preferably a positive displacement pump, the volume of ink added is directly proportional to the amount of time that pump 101-103 is run. Computer 120 calculates whether the required amount of ink has been added, and if not, computer 120 repeats steps 430 and 440. The number of times that computer 120 must repeat these steps is preferably based on the required amount of ink to add to the cartridge divided by the amount of ink added during step 430.

In step 460, computer 120 has added the required amount of ink to the cartridge, and indicates that the automatic refilling process is complete.

The user can then release the vacuum in chamber 170 by running vacuum pump 180 in the reverse direction, open the door to vacuum chamber 170 and remove the cartridge.

A recording media storing a program for accomplishing the above-mentioned apparatus may be accomplished by programming functions of the above mentioned apparatuses with a programming language readable by a computer 600 or processor, and recording the program on a media such as mentioned above.

A server equipped with a hard disk drive may be employed as a recording media. It is also possible to accomplish the present invention by storing the above mentioned computer program on such a hard disk in a server and reading the computer program by other computers through a network.

As a computer processing device 600, any suitable device for performing computations in accordance with a computer program, may be used. Examples of such devices include a personal computer, a laptop computer, a microprocessor, a programmable logic device, or an application specific integrated circuit.

In accordance with the foregoing description, the present invention provides the following advantages:

Because the ink filling process is completely automated, the reliability of the refilled cartridge is greatly improved.

By using a positive displacement pump, computer 120 can precisely control the amount of ink that is added to the cartridge to prevent problems caused by overfilling the cartridge.

By filling the cartridge while it is under a vacuum, air binding problems are eliminated.

Having thus described at least illustrative embodiments of the invention, various modifications and improvements will readily occur to those skilled in the art and are intended to be within the scope of the invention. Accordingly, the foregoing description is by way of example only and is not intended as limiting. The invention is limited only as defined in the following claims and the equivalents thereto.

What is claimed is:

1. A method of refilling a printer ink cartridge, the method comprising:

placing the cartridge in a vacuum chamber;

reducing pressure in the vacuum chamber to a target reduced pressure, the target reduced pressure being at or between 0.4 to 0.9 millibars below atmospheric, wherein a vacuum is applied to remove entrapped air from the cartridge;

adding an amount of ink during a first time period while the cartridge is under the vacuum;

repeating the adding step until a required amount of ink has been added to the cartridge, wherein a pause between adding steps allows the ink to permeate a foam sponge within the cartridge.

2. The method of claim 1, wherein the pressure in the vacuum chamber is reduced to about 0.7 millibars below atmospheric.

3. The method of claim 1 wherein the required amount of ink is determined from cartridge identifying information.

4. The method of claim 3 wherein the required amount of ink is based on a difference in weight of a new cartridge and an empty cartridge.

5. The method of claim 4, wherein a number of times the adding step is repeated is based on the amount added during the first time period and the required amount of ink.

6. The method of claim 1 further comprising pausing for a second time period between adding steps.

7. The method of claim 1, further comprising removing ink from the cartridge by centrifuge if the cartridge weighs more than about two grams above an empty weight.

8. The method of claim 7, further comprising ultrasonically cleaning the cartridge.

9. The method of claim 8, further comprising steam cleaning a print head on the cartridge.

10. A method of refilling a printer ink cartridge, the method comprising:

determining cartridge identifying information respective to the printer ink cartridge subject to being refilled;

determining a target reduced pressure based upon the respective cartridge identifying information;

placing the cartridge in a vacuum chamber;

reducing pressure in the vacuum chamber to the target reduced pressure respective to the cartridge, the target reduced pressure being at or between 0.4 to 0.9 millibars below atmospheric, wherein the vacuum is applied to remove entrapped air from the cartridge;

adding an amount of ink during a first time period while the cartridge is under a vacuum;

repeating the adding step until a required amount of ink has been added to the cartridge, wherein a pause between adding steps allows the ink to permeate a foam sponge within the cartridge.

11. The method of claim 10 wherein the required amount of ink is determined from the respective cartridge identifying information.

12. The method of claim 10 wherein the required amount of ink is based on a difference in weight of a new cartridge and an empty cartridge.

13. The method of claim 10, wherein a number of times the adding step is repeated is based on the amount added during the first time period and the required amount of ink.

14. The method of claim 10, further comprising at least one of the steps of:

a) ultrasonically cleaning the cartridge, and b) steam cleaning a print head on the cartridge.

15. The method of claim 10, the method further comprising the step of determining a pause time based upon the respective cartridge identifying information.

16. A method of refilling a printer ink cartridge, the method comprising:

determining cartridge identifying information respective to the printer ink cartridge subject to being refilled;

placing the cartridge in a vacuum chamber;

reducing pressure in the vacuum chamber to a target reduced pressure, the target reduced pressure being at or between 0.4 to 0.9 millibars below atmospheric, wherein a vacuum is applied to remove entrapped air from the cartridge;

determining the amount of ink that is added during each time period based upon the cartridge identifying information;

adding an amount of ink during a first time period while the cartridge is under the vacuum;

repeating the adding step until a required amount of ink has been added to the cartridge, wherein a pause between adding steps allows the ink to permeate a foam sponge within the cartridge.

17. The method of claim 16 wherein the required amount of ink is based on a difference in weight of a new cartridge and an empty cartridge.

18. The method of claim 16, the method further determining the target reduced pressure based upon the respective cartridge identifying information.

19. The method of claim 16, further comprising at least one of the steps of:

a) ultrasonically cleaning the cartridge, and b) steam cleaning a print head on the cartridge.

20. The method of claim 16, further comprising removing ink from the cartridge by centrifuge if the cartridge weighs more than about two grams above an empty weight.

21. The method of claim 16, the method further comprising the step of determining a pause time based upon the respective cartridge identifying information.

* * * * *